US006585053B2

(12) United States Patent
Coon

(10) Patent No.: US 6,585,053 B2
(45) Date of Patent: Jul. 1, 2003

(54) METHOD FOR CREATING A POLISHED BORE RECEPTACLE

(75) Inventor: Robert Joe Coon, Missouri City, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/949,057

(22) Filed: Sep. 7, 2001

(65) Prior Publication Data

US 2003/0047321 A1 Mar. 13, 2003

(51) Int. Cl.[7] ..... E21B 33/10
(52) U.S. Cl. ..... 166/387; 166/380; 166/384
(58) Field of Search ..... 166/380, 382, 166/387, 384, 207, 209, 216, 217

(56) References Cited

U.S. PATENT DOCUMENTS

| | | | | |
|---|---|---|---|---|
| 761,518 | A | 5/1904 | Lykken | |
| 1,324,303 | A | 12/1919 | Carmichael | |
| 1,545,039 | A | 7/1925 | Deavers | |
| 1,561,418 | A | 11/1925 | Duda | |
| 1,569,729 | A | 1/1926 | Duda | |
| 1,597,212 | A | 8/1926 | Spengler | |
| 1,930,825 | A | 10/1933 | Raymond | |
| 1,981,525 | A | 11/1934 | Price | |
| 2,214,226 | A | 9/1940 | English | |
| 2,216,226 | A | 10/1940 | Bumpous | 36/44 |
| 2,383,214 | A | 8/1945 | Prout | 153/82 |
| 2,499,630 | A | 3/1950 | Clark | 153/81 |
| 2,627,891 | A | 2/1953 | Clark | 153/872 |
| 2,663,073 | A | 12/1953 | Bieber et al. | 29/148 |
| 2,898,971 | A | 9/1959 | Hempel | 153/82 |
| 3,087,645 | A | 4/1963 | Wooley | 166/46 |
| 3,191,677 | A | 6/1965 | Kinley | 166/14 |
| 3,195,646 | A | 7/1965 | Brown | 166/208 |

(List continued on next page.)

FOREIGN PATENT DOCUMENTS

| | | | |
|---|---|---|---|
| EP | 0 961 007 | 12/1999 | E21B/33/10 |
| FR | 1 448 304 | 9/1976 | E21B/33/13 |
| GB | 2 216 926 | 10/1989 | E21B/7/20 |
| GB | 2 320 734 | 7/1998 | E21B/33/127 |
| GB | 2 329 918 | 4/1999 | E21B/43/10 |
| GB | 2 347 950 | 9/2000 | E21B/33/047 |
| GB | 2 347 952 | 9/2000 | E21B/43/10 |
| WO | WO 93/24728 | 12/1993 | E21B/17/10 |
| WO | WO 99/18328 | 4/1999 | E21B/23/01 |
| WO | WO 99/23354 | 5/1999 | E21B/43/10 |
| WO | WO 00/37773 | 6/2000 | E21B/43/10 |

OTHER PUBLICATIONS

International Search Report, International Application No. PCT/GB 02/04069, dated Dec. 18, 2002.

(List continued on next page.)

*Primary Examiner*—David Bagnell
*Assistant Examiner*—Zakiya Walker
(74) *Attorney, Agent, or Firm*—Moser, Patterson & Sheridan, L.L.P.

(57) ABSTRACT

A method for creating a seal between two tubulars in a wellbore is provided. In one aspect, the method allows for the top end of a first tubular to be sealingly mated to the bottom end of a second tubular. The first tubular is positioned at a selected depth within the wellbore. An expander tool is then run into the wellbore, and the top end of the first tubular is expanded along a desired length. The inner surface of the top end is expanded from a first diameter to a second diameter which will mate with the lower end of the second tubular. The expander tool is removed, and the second tubular is run into the wellbore. The bottom end of the second tubular is then sealingly mated with the top end of the first tubular. In one embodiment, the first tubular defines a string of casing which is expanded to create a polished bore receptacle for receiving a string of production tubing.

9 Claims, 3 Drawing Sheets

U.S. PATENT DOCUMENTS

| | | | | |
|---|---|---|---|---|
| 3,467,180 | A | 9/1969 | Pensotti | 165/180 |
| 3,712,376 | A | 1/1973 | Owen et al. | 166/277 |
| 3,776,307 | A | 12/1973 | Young | 166/125 |
| 3,818,734 | A | 6/1974 | Bateman | 72/75 |
| 3,911,707 | A | 10/1975 | Minakov et al. | 72/76 |
| 3,948,321 | A | 4/1976 | Owen et al. | 166/277 |
| 4,069,573 | A | 1/1978 | Rogers, Jr. et al. | 29/421 R |
| 4,127,168 | A | 11/1978 | Hanson et al. | 166/123 |
| 4,159,564 | A | 7/1979 | Cooper, Jr. | 29/727 |
| 4,288,082 | A | 9/1981 | Setterberg, Jr. | 277/125 |
| 4,319,393 | A | 3/1982 | Pogonowski | 29/434 |
| 4,324,407 | A | 4/1982 | Upham et al. | 277/27 |
| 4,429,620 | A | 2/1984 | Burkhardt et al. | 91/395 |
| 4,531,581 | A | 7/1985 | Pringle et al. | 166/120 |
| 4,588,030 | A | 5/1986 | Blizzard | 166/120 |
| 4,697,640 | A | 10/1987 | Szarka | 166/120 |
| 4,848,469 | A | 7/1989 | Baugh et al. | 166/382 |
| 5,052,483 | A | 10/1991 | Hudson | 166/55 |
| 5,271,472 | A | 12/1993 | Leturno | 175/107 |
| 5,348,095 | A | 9/1994 | Worrall et al. | 166/380 |
| 5,409,059 | A | 4/1995 | McHardy | 166/208 |
| 5,435,400 | A | 7/1995 | Smith | 175/61 |
| 5,472,057 | A | 12/1995 | Winfree | 175/57 |
| 5,560,426 | A | 10/1996 | Trahan et al. | 166/120 |
| 5,685,369 | A | 11/1997 | Ellis et al. | 166/195 |
| 5,743,335 | A | 4/1998 | Bussear | 166/285 |
| 5,901,787 | A | 5/1999 | Boyle | 166/135 |
| 6,021,850 | A | 2/2000 | Wood et al. | 166/380 |
| 6,029,748 | A | 2/2000 | Forsyth et al. | 166/380 |
| 6,098,717 | A | 8/2000 | Bailey et al. | 166/382 |
| 6,446,724 | B2 * | 9/2002 | Baugh et al. | 166/285 |
| 6,470,966 | B2 * | 10/2002 | Cook et al. | 166/207 |
| 2002/0166664 | A1 | 11/2002 | Lauritzen et al. | 166/277 |

OTHER PUBLICATIONS

PCT International Preliminary Examination Report from PCT/GB99/04365, Dated Mar. 23, 2001.

Partial International Search Report from PCT/GB00/04160, Dated Feb. 2, 2001.

UK Search Report from GB 9930398.4, Dated Jun. 27, 2000.

UK Search Report from GB 9930166.5, Dated Jun. 12, 2000.

PCT International Search Report from PCT/GB99/04246, Dated Mar. 3, 2000.

PCT International Search Report from PCT/GB99/04365, Dated Mar. 3, 2000.

* cited by examiner

METHOD FOR CREATING A POLISHED BORE RECEPTACLE

BACKGROUND OF THE INVENTION

1. Field of the Invention

The present invention relates to wellbore completion. More particularly, the invention relates to a system of completing a wellbore through the expansion and joining of tubulars. More particularly still, the invention relates to the expansion of one tubular into another tubular so as to create a downhole seal therebetween.

2. Description of the Related Art

Hydrocarbon and other wells are completed by forming a borehole in the earth and then lining the borehole with steel pipe or casing to form a wellbore. After a section of wellbore is formed by drilling, a section of casing is lowered into the wellbore and temporarily hung therein from the surface of the well. Using apparatus well known in the art, the casing is cemented into the wellbore by circulating cement into the annular area defined between the outer wall of the casing and the borehole. The combination of cement and casing strengthens the wellbore and facilitates the isolation of certain areas of the wellbore for production of hydrocarbons. Cementing also protects the surrounding formation environment.

It is common to employ more than one string of casing in a wellbore. In this respect, a first string of casing is set in the wellbore when the well is drilled to a first designated depth. The well is then drilled to a second designated depth, and a second string of casing, or liner, is run into the well. The second string is set at a depth such that the upper portion of the second string of casing overlaps the lower portion of the first string of casing. The second liner string is then hung in the wellbore, usually by some mechanical slip mechanism, and cemented. This process is typically repeated with additional casing strings until the well has been drilled to total depth. In this manner, wells are typically formed with strings of casing of an ever-decreasing diameter.

In some instances, wells are completed by perforating the lowest string of casing to provide a fluid path for hydrocarbons to enter the wellbore. From there, hydrocarbons flow into a screened portion of another smaller tubular, referred to as the production tubing. The production tubing is isolated with packers to seal off the annular area between the production tubing and the casing, thereby urging hydrocarbons into the production tubing.

In other completions, the lowest string of casing is preslotted before being run into the wellbore. A packer having a polished bore receptacle is positioned in the liner above the perforated region. A polished bore receptacle has a smooth cylindrical inner bore designed to receive and seal a tubular having a seal assembly on the outer surface of its lower end. The lower end of the production tubing is inserted into the polished bore receptacle. In this regard, the production tubing is lowered into the wellbore and "stung" into the polished bore receptacle of the packer to form a sealed connection. Fluid communication is thereby achieved between the producing zones of the well and the surface.

The body of a packer necessarily requires wellbore space and reduces the bore size available for production tubing and downhole production equipment. Therefore, there is a need for a packer for sealing a downhole annular area which is expandable, thereby providing a larger bore space to accommodate production tubing and equipment.

Emerging technology permits wellbore tubulars to be expanded in situ. An application of this is disclosed in U.S. Pat. No. 5,348,095, issued to Worrall, et al., in 1994. Worrall, et al., teaches the use of a conical tool downhole in order to expand a portion of a tubular into a surrounding formation wall, thereby sealing off the annular region therebetween.

It is known by inventor to utilize an expander tool having hydraulically activated rollers in order to expand an inner tubular into fluid communication with a larger outer tubular. The expander tool is lowered into the inner tubular on a working string, and positioned at the desired depth of expansion. Rollers disposed radially around the body of the expander tool are then actuated so as to apply an outward radial force from within the inner tubular. The body of the expander tool is then rotated so as to expand the inner tubular circumferentially into the outer tubular.

A shortcoming with the use of rotating expander tools is the likelihood of obtaining an uneven expansion of a tubular. In this respect, the inner diameter of the tubular that is expanded tends to assume the shape of the compliant rollers of the expander tool, including imperfections in the rollers. Also, the inside surface of the tubular is necessarily roughened by the movement of the rollers of the expander tool during expansion. Moreover, the compliant rollers are of a limited length, meaning that the working string must be moved up and down in order to apply the actuated rollers to different depths of a tubular to be expanded. This creates the likelihood that some portions of a tubular may be missed in the expansion process. The overall result is that the inner diameter of the expanded tubular is not perfectly round and no longer has a uniform inner circumference.

However, because of the above disadvantages with the roller-type expander tool, it is difficult to create a seal between an outer tubular and an inner expanded tubular dowhole. This, in turn, renders it impractical to utilize the roller-type expander tool for expanding the top of a liner to receive production tubing without a separate packer having a polished bore receptacle.

There is a need, therefore, for a method of creating a downhole seal between utilizing expansion technology. There is also a need to apply expandable tubular technology to the placement of a string of production tubing into a lower string of casing. Still further, there is a need for a method that can create a polished bore receptacle in a tubular for sealingly engaging production tubing in a wellbore.

SUMMARY OF THE INVENTION

The present invention provides a method for creating a polished bore receptacle, ii situ, using a standard tubular. The method is accomplished through tubular expansion technology.

The method of the present invention first comprises positioning a lower string of casing into a wellbore. The top portion of the lower string of casing will necessarily overlap with the bottom end of an intermediate or upper string of casing. Then, a conical expander tool is lowered into the wellbore on a working string. The cone is configured to enter the top end of the lower string of casing, and then expand its inner diameter upon complete entry. The swaged cone is forced a selected distance into the lower string of casing so as to apply a radial force to the inner surface of the tubular, thereby radially expanding the top end of the lower string of casing.

The use of a conformed, conical expander tool provides a smooth expansion and gives a consistent radial dimension to the inner surface of the lower string of casing. The conical expander avoids the inconsistent expansion provided in connection with the roller-type expander tool.

Once the expander tool has been forced a selected distance into the lower string of casing, the expander tool is removed. A uniform polished bore receptacle is thus created. The lower end of the production tubing can then be sealably mated into the polished bore receptacle.

BRIEF DESCRIPTION OF THE DRAWINGS

So that the manner in which the above-recited features, advantages, and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENTS

Figure 1:
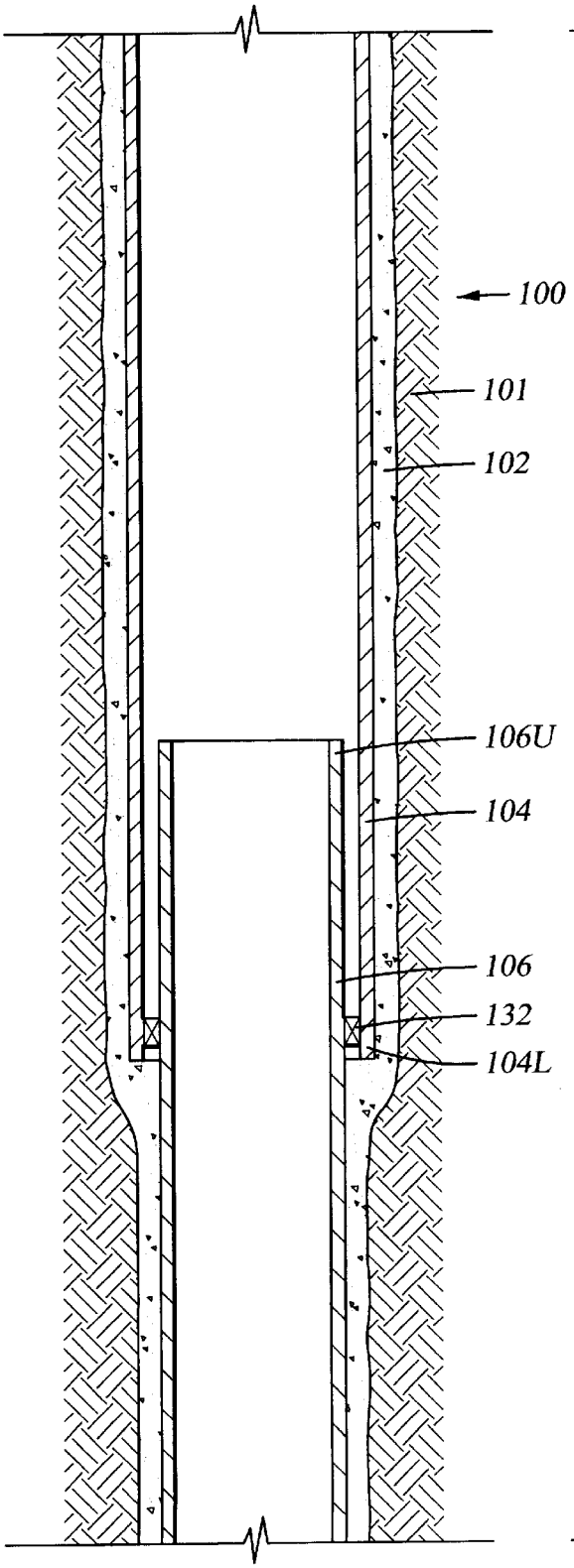
FIG. 1 is a section view of an upper string of casing set within a wellbore, and a lower string of casing disposed to overlap within the upper casing string.

FIG. 1 is a section view of an upper string of casing 104 set within a wellbore 100. The upper string of casing 104 is typically cemented into the wellbore 100 so as to preserve the stability of the formation 101 and to control the migration of fluids into and out of the formation 101. Cement is depicted at 102. However, it will be understood by those of ordinary skill in the art that the upper casing string 104 may be affixed to the formation 101 by pressure from back filling in the formation 101.

The upper string of casing 104 in the embodiment of FIG. 1 is a string of surface casing, that is, it extends into the wellbore 100 from the surface. However, the upper string of casing 104 could define, in another aspect of the present invention, a string of intermediate casing above the lowest string of casing 106. Therefore, as defined herein, the term "upper string of casing" refers to that casing string which is immediately above the lower string of casing 106. The term "the lower string of casing", in turn, refers to the string of casing which is to be placed in sealed fluid communication with the production tubing (shown later as 128 in FIG. 5).

In FIG. 1, a lower string of casing 106 is disposed more or less concentrically within the upper casing string 104. This means that the lower string of casing 106 has a smaller outer diameter than the inner diameter of the upper string of casing 104. The lower string of casing 106 has an upper end 106U which overlaps with a lower end 104L of the upper string of casing 104. The lower string of casing 106 may be cemented into the wellbore 100, or more typically, may simply be hung from the upper string of casing 104. In the embodiment of FIG. 1, the lower string of casing 106 is hung from the upper string of casing 104 by use of slips 132. However, other hanging devices may be employed.

The lower string of casing 106 has a lower end (not shown) which extends to the lower portions of the wellbore 100. It is understood that the upper string of casing 104 also has an upper end within the wellbore, which is not shown.

Figure 2:
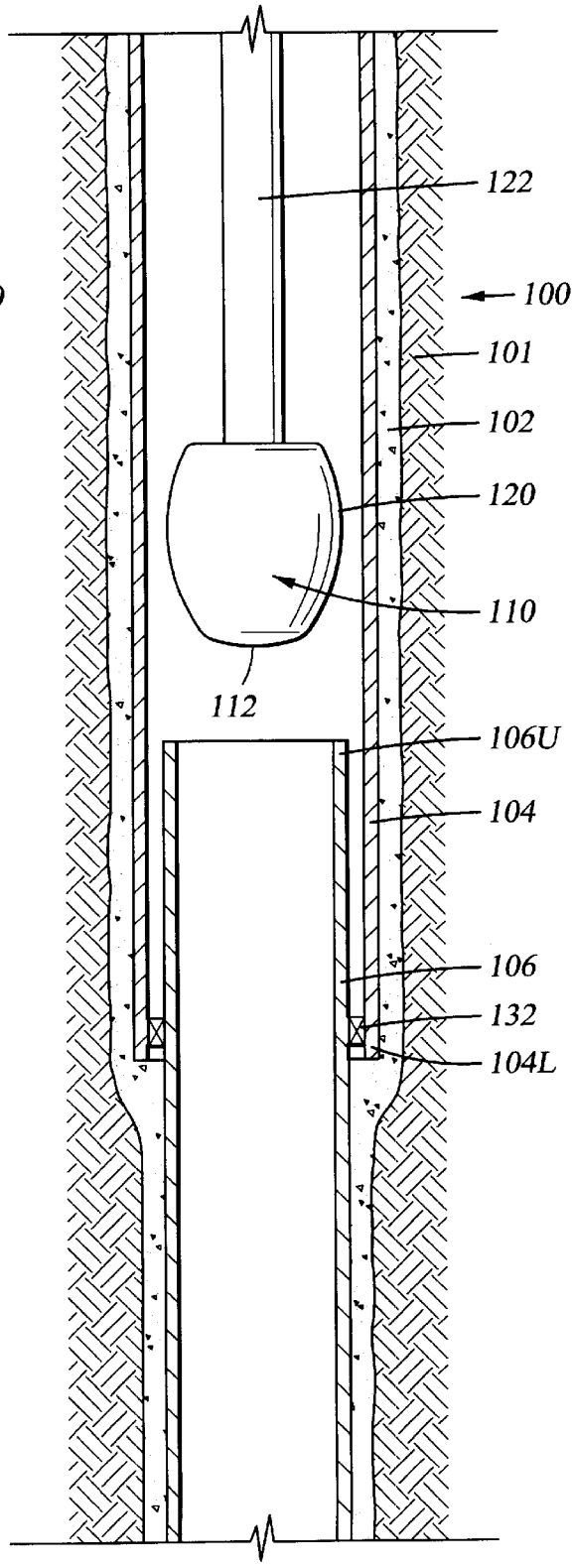
FIG. 2 is a section view of the wellbore of FIG. 1, with an expander tool being lowered into the wellbore.

FIG. 2 is a section view showing the lower string of casing 106 disposed within the upper string of casing 104. FIG. 2 further depicts a swaged expander tool 110 being lowered into the wellbore 100. The expander tool 110 is dimensioned to freely move within the upper string of casing 104. This means that the outer diameter of the expander tool 110 at its widest point 120 is smaller than the inner diameter of the upper string of casing 104. At the same time, the expander tool 110 has an outer diameter at its widest point 120, that is wider than the inner diameter of the lower string of casing 106. Thus, the expander tool 110 can only enter the lower string of casing 106 by force.

The expander tool 110 shown in FIG. 2 is generally conical in shape. However, it is within the scope of this invention to use other shapes of a conformed expander tool 110. Any configuration of an expander tool 110 which is conformed to provide a leading end 112 which will freely enter the casing 106 to be expanded, but which tapers outwardly to an outer diameter 120 in order to expand the casing 106 to its appropriate dimension as a polished bore receptacle upon forced entry, is acceptable. The configuration of the expander tool 110 in FIG. 2 is referred to as a "swaged cone."

The swaged cone 110 is lowered into the wellbore 100 by a run-in string 122. The run-in string defines a tubular having an inner bore (not shown) for receiving fluid. The run-in string 122 is initially lowered into the wellbore 100 mechanically, and with the aid of gravity. However, a hydraulic pumping system (not shown) is also preferably employed in order to force the cone 110 into the lower string of casing 106.

Figure 3:
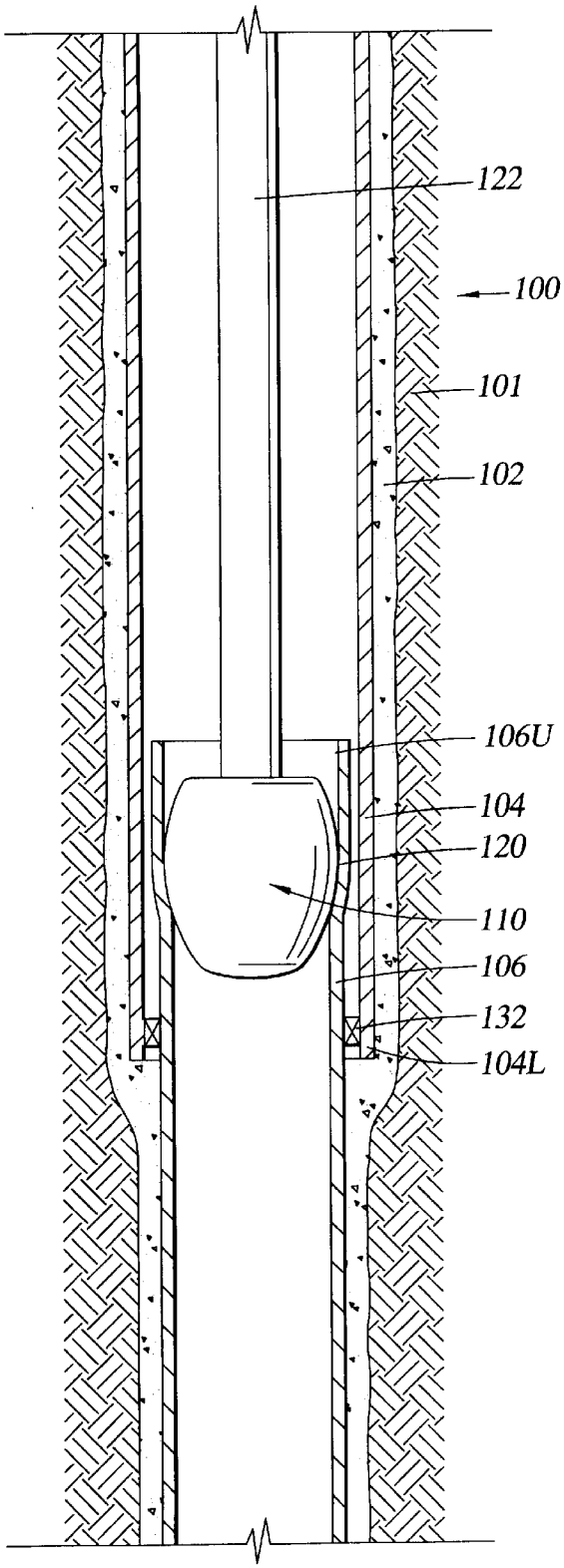
FIG. 3 is a section view of the wellbore of FIG. 2, showing the lower string of casing being expanded by the forced entry of the conformed expander tool therein.

FIG. 3 depicts the expander tool 110, or swaged cone, being forced into the top end 106U of the lower casing string 106. Downward force urges the swaged cone 110 into the lower string of casing 106, which in turn causes the cone 110 to act against the lower string of casing 106 and to radially expand the top end 106U thereof. During the expansion of the lower string of casing 106, the top end 106U undergoes elastic, and then plastic, radial deformation. The top end 106U of the lower string of casing 106 is imparted a new diameter that conforms to the widest point 120 of the swaged cone 110.

Figure 4:
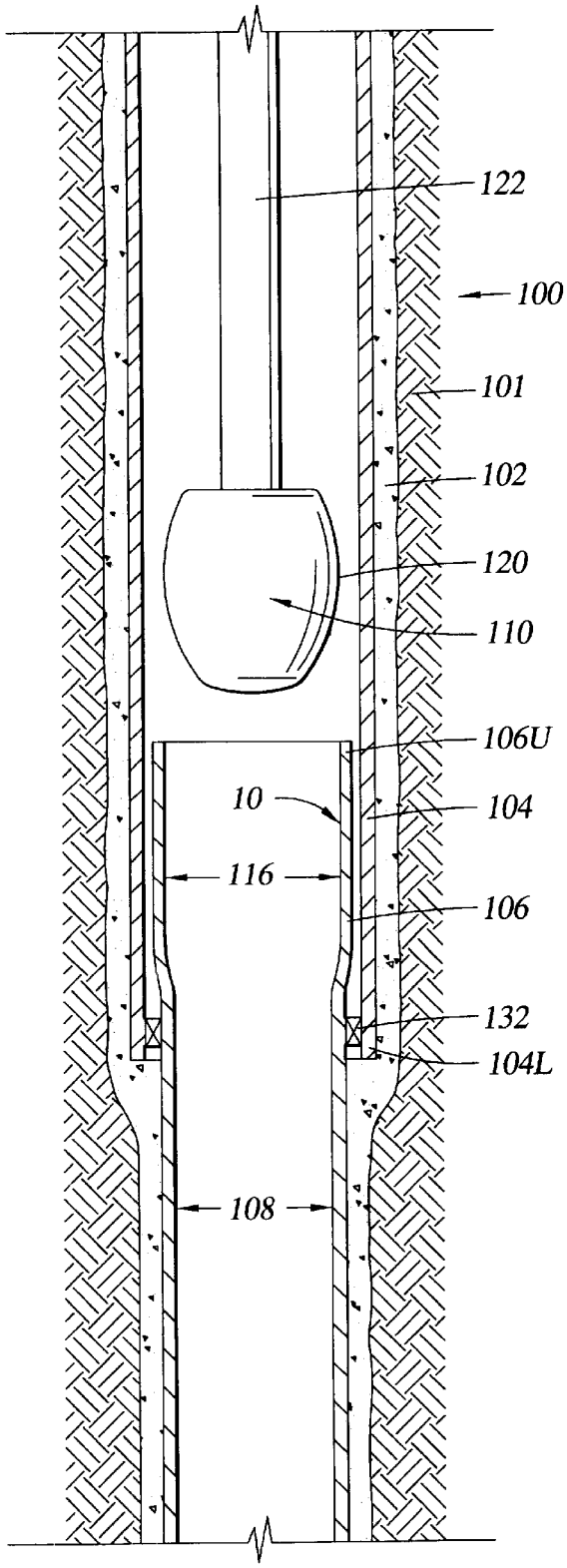
FIG. 4 is a section view showing the wellbore of FIG. 3, after the top end of the lower string of casing has been expanded by the forced entry of the expander tool therein. The inner surface of the expanded portion of the lower string of casing now defines a polished bore receptacle. The conical expander tool is being removed from the wellbore.

FIG. 4 is a section view showing the wellbore 100 after the top end 106U of the lower string of casing 106 has been expanded by the forced entry of the swaged cone 110 therein. The inner surface of the upper end 106U has been expanded from a first diameter 108 to a second diameter 116. The inner surface of the expanded portion of the lower string of casing 106 now defines a polished bore receptacle 10. The expander tool 110 is being removed from the wellbore 100.

After the top end 106U of the lower string of casing 106 has been expanded, the downward force is relieved from the swaged cone 110. In FIG. 4, the cone 110 is being removed from the wellbore 100. The resulting polished wellbore receptacle 10 left in the wellbore 100 has a high degree of concentricity. The inner surface of the polished bore receptacle 10 further has a smooth surface sufficient for sealingly mating with the lower end of a string of production tubing, shown as 125 in FIG. 5.

Figure 5:
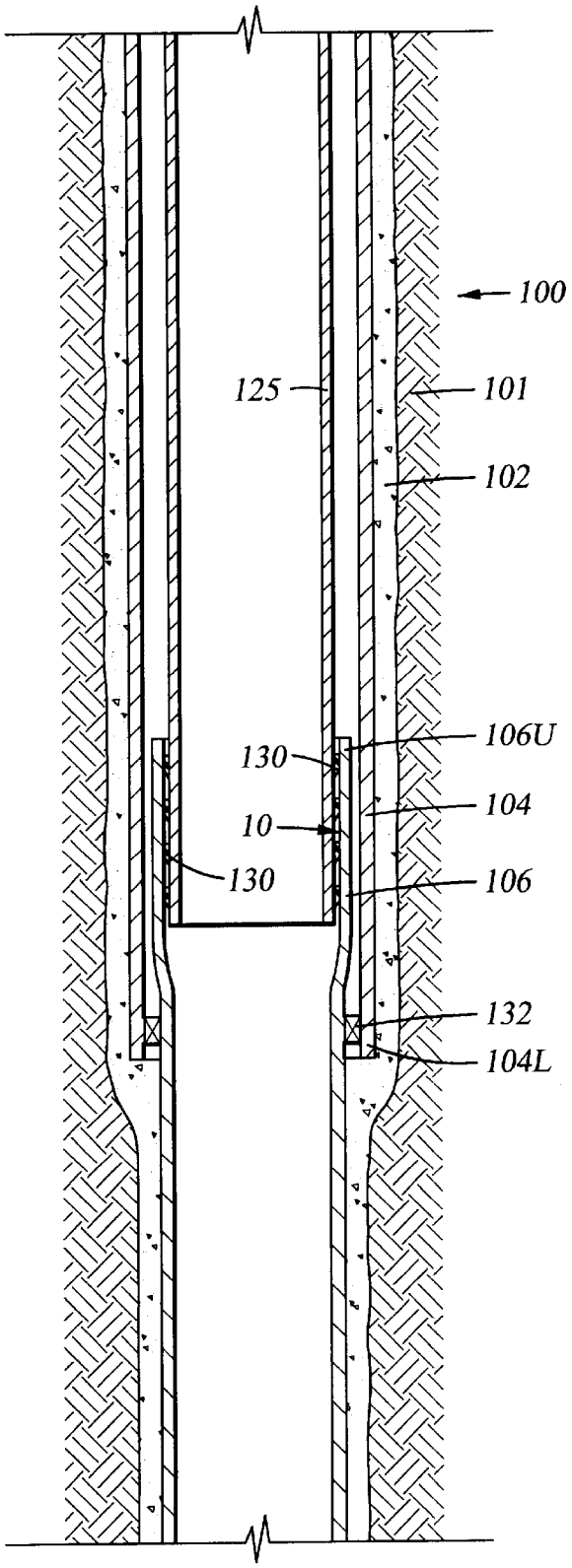
FIG. 5 is a section view showing the wellbore of FIG. 4, with a string of production tubing being mated into the polished bore receptacle.

FIG. 5 is a section view showing a string of production tubing 125 being mated into the polished bore receptacle 10. The outer diameter of the production tubing 125 is a configured to land in the expanded portion, or wellbore receptacle 10, of the lower string of casing 106. A fluid seal is created between the outer diameter of the production tubing 125 and the polished bore receptacle 10 by applying a sealing element 130 around the outer surface of the production tubing 125 before the production tubing 125 is run into the polished bore receptacle 20. The sealing element 130 is preferably a plurality of elastomeric rings disposed circumferentially around the outer surface of the production tubing 125 at its lower, or bottom end. Examples of such a sealing element 130 would be an O-ring. However, it will be appreciated by those skilled in the art that other methods, including but not limited to, gaskets adhesives, helical non-elastomeric fins, ext., may also be used to create a sealing relationship between the production tubing 25 and the polished bore receptacle 10.

Figure 6:
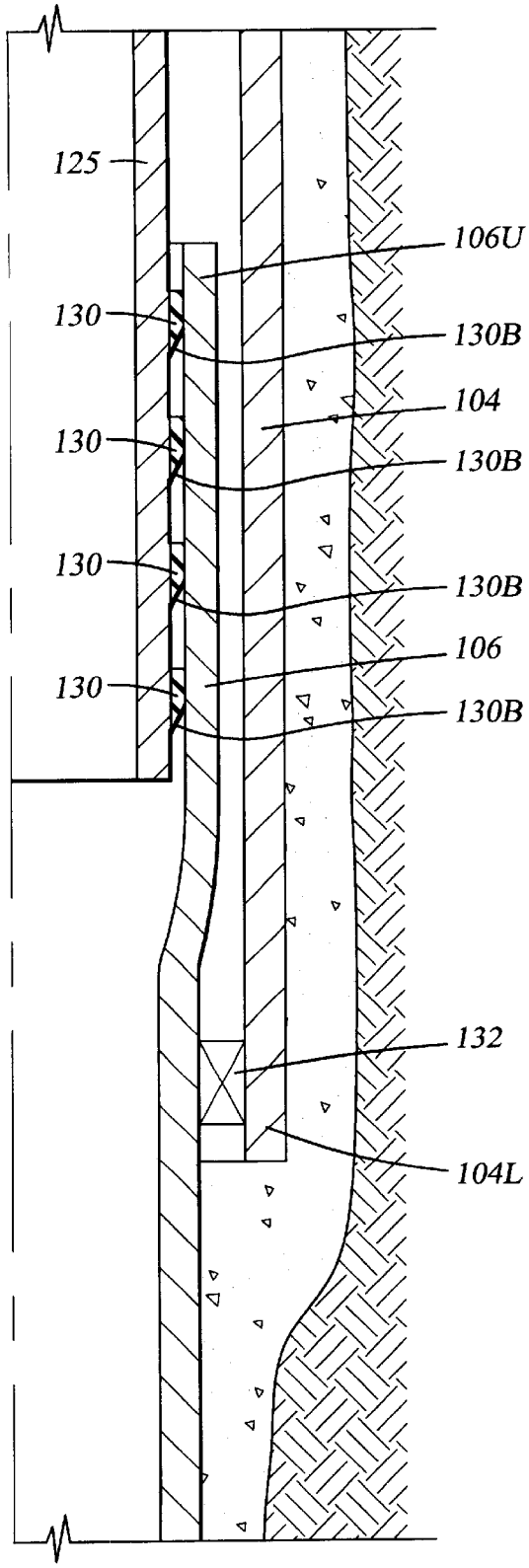
FIG. 6 depicts an enlarged cross-sectional view of the upper string of the wellbore of FIG. 5, so as to more fully show the placement of sealing elements between the production tubing and the polished bore receptacle

FIG. 6 depicts an enlarged cross-sectional view of the upper string of casing 104, the lower string of casing 106, and the production tubing 125 all within a wellbore 100. Visible in this enlarged cross-sectional view is a plurality of sealing elements 130. In the embodiment shown in FIG. 6, the sealing elements 130 each include a lower beveled portion 130B to aid in the entry of the production tubing 125 into the polished bore receptacle 10.

While the foregoing is directed to embodiments of the present invention, other and further embodiments of the invention may be devised without departing from the basic scope thereof, and the scope thereof is determined by the claims that follow.

What is claimed is:

1. A method for creating a downhole seal between a first tubular and a second tubular, the first and second tubulars each having a top end and a bottom end, comprising the steps of:

positioning the first tubular at a selected depth within the wellbore;

expanding the inner diameter of the top end of the first tubular;

running the second tubular into the wellbore; and mating the bottom end of the second tubular into the top end of the first tublar, the bottom end of the second tubular being configured to sealingly land into the expanded inner diameter of the first tubular, thereby creating a fluid seal between the first and second tubulars.

2. The method for creating a downhole seal between a first tubular and a second tubular of claim 1, wherein the outer surface of the bottom end of the second tubular has a sealing element for facilitating the fluid seal between the first and second tubulars.

3. The method for creating a downhole seal between a first tubular and a second tubular of claim 2, wherein the step of expanding the inner diameter of the top end of the first tubular is accomplished by applying a radial force to the inner surface of the first tubular so as to radially expand the inner surface of the first tubular from a first diameter to a second diameter along a selected length at the top end of the first tubular, thereby forming a polished bore receptacle.

4. The method for creating a downhole seal between a first tubular and a second tubular of claim 3, wherein the radial force applied to the first tubular is applied by forcing a swaged cone a distance into the top end of the first tubular, the swaged cone having a diameter at its lower end that is smaller than the diameter at the widest point of the swaged cone and that is also smaller than the inner diameter of the first tubular.

5. The method for creating a downhole seal between a first tubular and a second tubular of claim 4, wherein the first tubular defines a string of casing;

the wellbore further comprises at least one upper string of casing set in the wellbore immediately above the first tubular, the upper string of casing also having a top end and a bottom end;

the top end of the first tubular is positioned in the wellbore such that the top end of the first tubular overlaps with the bottom end of the upper string of casing; and the second tubular defines a string of production tubing.

6. The method for creating a downhole seal between a first tubular and a second tubular of claim 5, further comprising the step of removing the swaged cone from the wellbore after the polished bore receptacle has been created.

7. A method for creating a polished bore receptacle at the upper end of a string of casing comprising the steps of:

positioning the string of casing at a selected depth within a wellbore;

running a swaged cone into the wellbore at the lower end of a working string, the swaged cone having a diameter at its lower end that is smaller than the diameter at the widest point of the swaged cone and that is also smaller than the inner diameter of the string of casing;

forcing the swaged cone downward into the upper end of the string of casing along a desired distance, thereby expanding the inner surface of the upper end of the string of casing from a first diameter to a second diameter such that the second diameter is dimensioned to sealingly receive a lower end of a string of production tubing;

removing the swaged cone from the wellbore;

running the string of production tubing into the wellbore after the cone has been removed; and landing the bottom end of the string of production tubing into the expanded top end of the string of casing, the bottom end of the string of production tubing being configured to sealingly land into the expanded inner diameter of the string of casing, thereby creating a fluid seal between the string of casing and the string of production tubing.

8. The method for creating a polished bore receptacle at the upper end of a string of casing of claim 7, wherein the lower end of the string of production tubing has a sealing element around an outer surface for facilitating the fluid seal between the expanded inner surface of the upper end of the string of casing, and the lower end of the string of production tubing.

9. The method for creating a polished bore receptacle at the upper end of a string of casing of claim 8, wherein the sealing element comprises a plurality of elastomeric rings circumferentially disposed about the outer surface of the lower end of the production tubing.

* * * * *